US008511995B1

(12) United States Patent
Liang

(10) Patent No.: US 8,511,995 B1
(45) Date of Patent: Aug. 20, 2013

(54) TURBINE BLADE WITH PLATFORM COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 536 days.

(21) Appl. No.: 12/951,546

(22) Filed: Nov. 22, 2010

(51) Int. Cl.
*F01D 5/08* (2006.01)
*F01D 5/18* (2006.01)

(52) U.S. Cl.
USPC ..... 416/97 R; 416/96 R; 416/193 A; 415/115; 415/116

(58) Field of Classification Search
USPC ..... 416/96 R, 96 A, 97 R, 97 A, 193 A; 415/115, 116
See application file for complete search history.

(56) References Cited

U.S. PATENT DOCUMENTS

| | | | | |
|---|---|---|---|---|
| 6,120,249 | A * | 9/2000 | Hultgren et al. | 416/97 R |
| 6,132,173 | A * | 10/2000 | Tomita et al. | 416/96 R |
| 6,196,799 | B1 * | 3/2001 | Fukue et al. | 416/97 R |
| 6,887,033 | B1 * | 5/2005 | Phillips et al. | 415/115 |
| 7,695,247 | B1 * | 4/2010 | Liang | 416/97 R |
| 7,766,606 | B2 * | 8/2010 | Liang | 415/115 |

* cited by examiner

*Primary Examiner* — Igor Kershteyn
(74) *Attorney, Agent, or Firm* — John Ryznic

(57) ABSTRACT

A turbine rotor blade with a platform includes platform cooling channels on the pressure side and the suction side of the platform. The cooling channels are formed from straight section that generally follows a contour of the airfoil in order to provide cooling to as much of the platform surfaces as possible. Pressure side cooling channels have a V-shape from inlet to outlet. Suction side channels branch off from a common channel located along a suction side edge of the platform.

5 Claims, 2 Drawing Sheets

TURBINE BLADE WITH PLATFORM COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to an industrial turbine blade with platform cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

FIG. 1 shows a prior art first stage turbine rotor blade used in a large frame heavy duty industrial gas turbine engine. Cooling of the blade platform 12 is produced by passing cooling air through straight cooling channels that have a long length-to-diameter ratio. The pressure side of the platform 12 is cooled with three straight channels 13 each supplied with cooling air through inlet holes 16 that open on the bottom surface of the platform 12 with cooling air from the dead rim cavity located below the platform 12. The suction side of the platform 12 is cooled with three straight channels 15 that are all connected to a larger diameter and longer channel 14 located along the side edge of the platform 12. An inlet hole 16 also supplies the suction side channels 15 with cooling air from the rim cavity. An airfoil 11 extends from the platform 12.

The platform cooling circuit of the FIG. 1 blade suffers from several design problems. Using a film cooling method for the entire blade platform requires a cooling air supply pressure at the dead rim cavity to be at a higher pressure than the peak blade platform external gas side pressure. This platform cooling design induces a high leakage flow around the blade attachment section and therefore causes a performance penalty.

Also, uses long length-to-diameter ration cooling channels that are drilled from the platform edge to the airfoil cooling core in the blade platform wall will produce very high stress levels at the airfoil cooling core and platform cooling channel interface locations that will cause a low blade life. This affect is mainly due to the large mass at the front and back ends of the blade attachment which will constrain any blade platform expansion. Also, with the cooling channels oriented transverse to the primary direction of the stress field, high stress concentrations will occur at the cooling channel inlet holes.

An analysis of the FIG. 1 prior art turbine blade indicates that an over-temperature occurs at the platform pressure side location and at the aft portion of the suction side platform edge and the aft section of the suction side to platform junction.

BRIEF SUMMARY OF THE INVENTION

An industrial engine first stage turbine rotor blade with platform cooling channels to address the over-temperature affect of the prior art blade. the blade includes a platform with a pressure side surface and a suction side surface. The platform pressure side surface is cooled with a number of V-shaped cooling channels each include a cooling air inlet holes that opens into the dead rim cavity for cooling air supply. The platform suction side surface is cooled with a number of straight channels that branch off from one larger and long cooling channel than runs along the platform side to provide cooling along a larger surface area of the platform than the prior art design. The suction side channels on the forward end are each supplied with cooling inlet air holes that are also connected to the dead rim cavity.

DETAILED DESCRIPTION OF THE INVENTION

Figure 2:
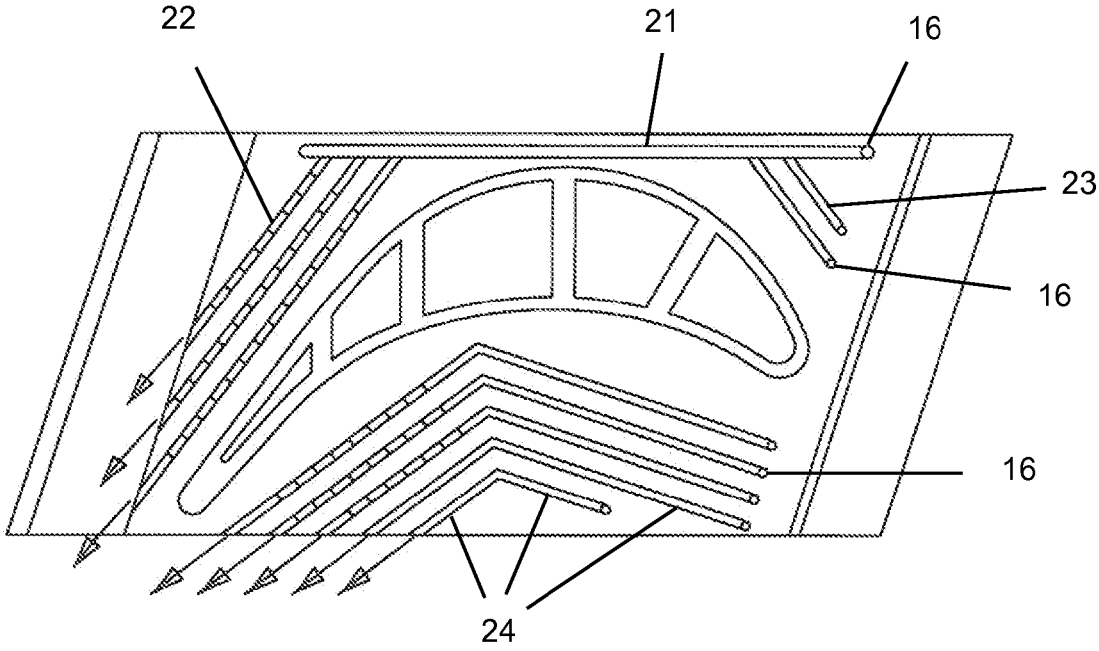
FIG. 2 shows a turbine rotor blade with platform cooling of the present invention.

An industrial engine first stage turbine rotor blade with platform cooling is shown in FIG. 2 with an airfoil 11 extending from a platform 12. The platform 12 includes a pressure side surface and a suction side surface. The pressure side surface is cooled with a number of V-shaped cooling channels 24 formed within the wall of the platform. The V-shaped cooling channels 24 extend from a forward section to an aft section of the platform 12 to provide cooling for as much of the platform as possible. Each of the V-shaped cooling channels 24 have two straight channel sections that are connected at a V that is located closer to the pressure side wall than the inlet or the outlet of the V-shaped channel as seen in FIG. 2. Each pressure side cooling channel 24 is connected to the dead rim cavity through an inlet hole 16 and discharges the cooling air through exit holes located on the side of the platform edge.

The suction side wall surface of the platform is cooled with a number of straight cooling channels that are all connected to a common larger diameter cooling channel 21 that extends along the side edge of the platform 12. Two cooling air channels 23 are located on the forward section of the suction side wall of the platform with each connected to the dead rim cavity by inlet holes 16. The cooling channels 23 discharge into the common channel 21 that then feed the cooling channels 22 located along the aft side of the suction side wall of the platform and discharge out the side edge of the platform. The suction side channels 23 and 22 together with the common channel 21 form a V-shaped cooling channel in that the two channels 22 and 23 branch away from the inlet ends of these channels.

Figure 1:
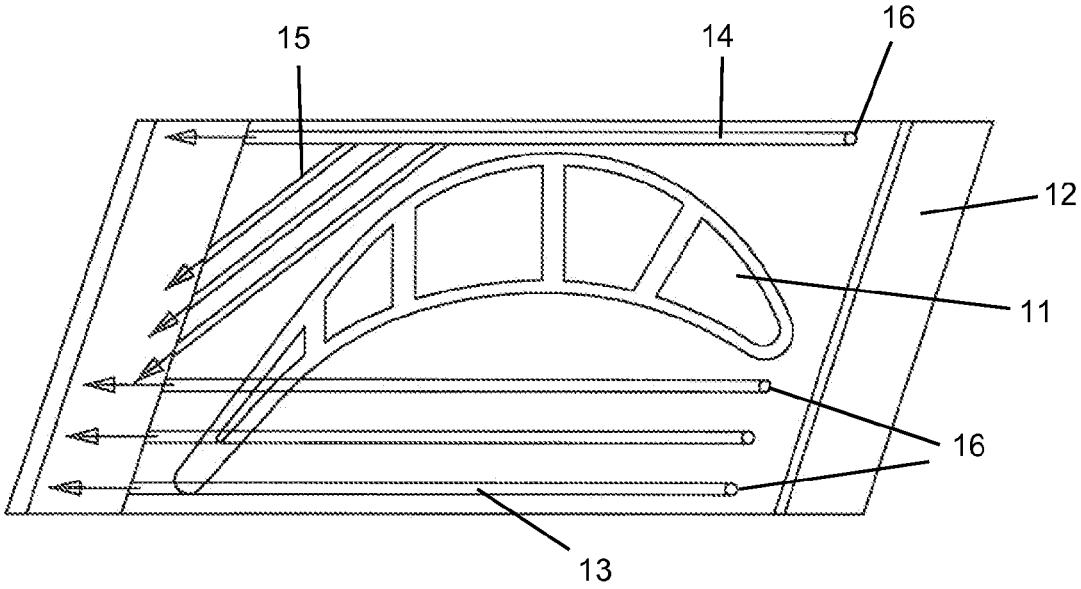
Fig 1 prior art
FIG. 1 shows a prior art industrial first stage turbine rotor blade with platform cooling.

The number of cooling channels used on the pressure side and suction side of the platform will depend on the cooling capability of the channels. The cooling air supply and discharge cooling channels are formed as parallel to the adjacent airfoil surfaces on the pressure side and suction side contours as possible in order to maximize the platform surface cooling. The straight sections of the platform cooling channels generally follow an airfoil contour of an adjacent airfoil surface as seen in FIG. 2. The hot spots on the platform described in the prior art FIG. 1 cooling design will be cooled by the V-shaped cooling channels of the present invention. To provide even better cooling, trip strips are used within the channels at these hot spot locations to enhance the cooling heat transfer affect.

Feeding the cooling air into the pressure side and suction side cooling channels from the front or forward end of the platform from the dead rim cavity will provide convection cooling for the platform pressure and suction side surfaces first before discharging the cooling air onto the aft mate-face locations of the platform. The airfoil pressure side and suction side platform surfaces will be cooled by the V-shaped convection cooling channels. the hot spots that are not covered by the straight cooling channels of the FIG. 1 prior art platform will be cooled by the V-shaped cooling channels of the present invention.

I claim the following:

1. An industrial engine turbine rotor blade comprising:

an airfoil extending from a platform;

the platform having a pressure side surface and a suction side surface;

a plurality of V-shaped cooling channels formed within the platform on the pressure side of the platform;

each V-shaped cooling channel includes an inlet hole located on a forward side of the platform and opening on a bottom side of the platform;

a straight common cooling channel located on the suction side of the platform and extending along a side edge from a forward side of the platform to an aft side of the platform;

a plurality of straight cooling channels on a forward side of the suction side of the platform each connected to an inlet hole opening on the bottom side of the platform and connected to the straight common cooling channel; and, a plurality of straight cooling channels on an aft side of the suction side of the platform each connected to the straight common cooling channel.

2. The industrial engine turbine rotor blade of claim 1, and further comprising:

the cooling channels on the pressure side of the platform discharge onto a pressure side edge of the platform; and, the cooling channels on the suction side of the platform discharge onto an aft side edge of the platform.

3. The industrial engine turbine rotor blade of claim 1, and further comprising:

the straight sections of the platform cooling channels generally follow an airfoil contour of an adjacent airfoil surface.

4. The industrial engine turbine rotor blade of claim 1, and further comprising:

the inlet holes for the pressure side and suction side platform cooling channels are located along a line on the forward side of the platform at a point about where the airfoil leading edge is located.

5. The industrial engine turbine rotor blade of claim 1, and further comprising:

the pressure side and suction side platform cooling channels include trip strips in locations where hot spots are likely to occur on the platform due to an over-temperature from inadequate cooling; and, the cooling channels at locations where hot spots are not likely to occur do not include trip strips.

* * * * *